US007718958B2

(12) United States Patent
Shiea et al.

(10) Patent No.: US 7,718,958 B2
(45) Date of Patent: May 18, 2010

(54) MASS SPECTROSCOPIC REACTION-MONITORING METHOD

(75) Inventors: Jentaie Shiea, Kaohsiung (TW); Cheng-Hui Yuan, Taipei (TW); Jhih-Yuan Jheng, Kaohsiung (TW)

(73) Assignee: National Sun Yat-Sen University, Kaohsing (TW)

( * ) Notice: Subject to any disclaimer, the term of this patent is extended or adjusted under 35 U.S.C. 154(b) by 212 days.

(21) Appl. No.: 11/926,434

(22) Filed: Oct. 29, 2007

(65) Prior Publication Data

US 2008/0290289 A1 Nov. 27, 2008

Related U.S. Application Data

(63) Continuation-in-part of application No. 11/561,131, filed on Nov. 17, 2006.

(51) Int. Cl.
*H01J 49/10* (2006.01)

(52) U.S. Cl. ..... 250/288; 250/281; 250/282; 250/287

(58) Field of Classification Search ..... 250/281, 250/282, 288, 286, 287, 423 R, 424, 425, 250/423 P; 435/287.1, 287.2; 239/418
See application file for complete search history.

(56) References Cited

U.S. PATENT DOCUMENTS 5,663,561 A 9/1997 Franzen et al.
6,649,907 B2 * 11/2003 Ebeling et al. ..... 250/288
6,838,663 B2 1/2005 Coon et al.
7,193,223 B2 * 3/2007 Franzen ..... 250/425
7,335,897 B2 * 2/2008 Takats et al. ..... 250/425
2003/0178562 A1 * 9/2003 Makarov et al. ..... 250/288
2004/0185448 A1 * 9/2004 Lopez-Avila et al. ..... 435/6
2005/0056776 A1 * 3/2005 Willoughby et al. ..... 250/281
2005/0153344 A1 * 7/2005 Diamond et al. ..... 435/6
2005/0181513 A1 * 8/2005 Lopez-Avila et al. ..... 436/86
2005/0230615 A1 * 10/2005 Furutani et al. ..... 250/287
2005/0230635 A1 * 10/2005 Takats et al. ..... 250/424
2006/0169914 A1 * 8/2006 Holle et al. ..... 250/423 P
2006/0247863 A1 * 11/2006 Bui ..... 702/19
2007/0224697 A1 * 9/2007 Park ..... 436/173
2008/0149822 A1 * 6/2008 Vertes et al. ..... 250/282

* cited by examiner

*Primary Examiner*—David A Vanore
*Assistant Examiner*—Michael J Logie
(74) *Attorney, Agent, or Firm*—Stephen A Bent; Foley & Lardner LLP

(57) ABSTRACT

A mass spectroscopic reaction-monitoring method including: forcing charge-laden liquid drops to move along a traveling path; exposing to a laser beam a region to be formed of a liquid sample surface, the laser beam having an irradiation energy sufficient to cause analytes present behind the liquid sample surface to be desorbed to fly along a flying path; introducing to the region at successive points of time a liquid sample containing one reactant that undergoes an ongoing chemical reaction as a first analyte to form one product as a second analyte; and positioning the liquid sample surface relative to the laser beam at each point of time such that the flying path intersects the traveling path for enabling occlusion of at least one of the first and second analytes in at least one charge-laden liquid drop to thereby form at least a corresponding one of first and second ionized analytes.

6 Claims, 7 Drawing Sheets

MASS SPECTROSCOPIC REACTION-MONITORING METHOD

CROSS-REFERENCE TO RELATED APPLICATION

This application is a continuation-in-part (CIP) of U.S. patent application Ser. No. 11/561,131, entitled "ELECTROSPRAY-ASSISTED LASER DESORPTION IONIZATION DEVICE, MASS SPECTROMETER, AND METHOD FOR MASS SPECTROMETRY", filed on Nov. 17, 2006.

BACKGROUND OF THE INVENTION

1. Field of the Invention

The invention relates to amass spectroscopic method, more particularly to a mass spectroscopic reaction-monitoring method.

2. Description of the Related Art

For a liquid sample undergoing a chemical reaction, composition thereof varies over time. State of the chemical reaction can be monitored by monitoring the presence/absence of substances in the liquid sample and quantity changes of the substances.

Various methods, such as classical analysis, Ultraviolet (UV), Nuclear Magnetic Resonance (NMR), Infrared (IR), and neon spectroscopic analyses, have conventionally been used individually or in combination for monitoring chemical reactions. However, time-consuming steps such as separation and purification are required. In addition, instantaneous monitoring of the chemical reaction cannot be conducted. In other words, relative quantities of various substances in a liquid sample cannot be acquired, and the growth and decline of the quantity of each of the substances over a certain period of time cannot be determined.

Although Electrospray Ionization (ESI) mass spectrometry can be used to monitor chemical reactions by making the liquid sample an electrospray solution, the following shortcomings occur as the composition of the liquid sample may be very complicated:

1. it is difficult to remove the liquid portion of the droplets formed by electrospraying (e.g., if the liquid sample is non-volatile);
2. the chemical reaction under monitor is easily affected by the addition of other solvents into the liquid sample for speeding up the removable of the liquid portion of the droplets, and by the addition of acidic substances into the liquid sample for enhancing ionizing efficiency of analytes in the liquid sample, thereby adversely affecting the credibility of the results obtained; and
3. it is prone to misinterpret the obtained mass spectrum when the liquid sample contains salt.

SUMMARY OF THE INVENTION

Therefore, the object of the present invention is to provide a mass spectroscopic method for monitoring a chemical reaction in a liquid sample that can be conducted with ease, convenience, and speed, and that is capable of revealing quantity variations of reactants, intermediate products and final products involved in the chemical reaction.

According to the present invention, there is provided a mass spectroscopic reaction-monitoring method that includes the steps of:

a) forcing sequentially generated charge-laden liquid drops to move towards a receiving unit of a mass spectrometer along a traveling path;

b) exposing to a laser beam a region that is to be formed of a liquid sample surface, the laser beam being transmitted from an overhead laser beam directing member and having an irradiation energy sufficient to cause analytes present behind the liquid sample surface relative to the laser unit to be desorbed to fly along at least one flying path;

c) introducing a liquid sample to the region so as to form the liquid sample surface at successive points of time that are respectively spaced a plurality of predetermined intervals apart, the liquid sample containing at least one reactant that undergoes an ongoing chemical reaction as a first one of the analytes to form at least one product that co-exist therewith as a second one of the analytes; and d) positioning the liquid sample surface relative to the laser beam at each of the successive points of time such that the at least one flying path intersects the traveling path to enable at least one of the coexisting first and second analytes to be occluded in at least one of the charge-laden liquid drops to thereby form at least a corresponding one of first and second ionized analytes.

BRIEF DESCRIPTION OF THE DRAWINGS

Other features and advantages of the present invention will be come apparent in the following detailed description of the preferred embodiment with reference to the accompanying drawings, of which.

DETAILED DESCRIPTION OF THE PREFERRED EMBODIMENT

Figure 1:
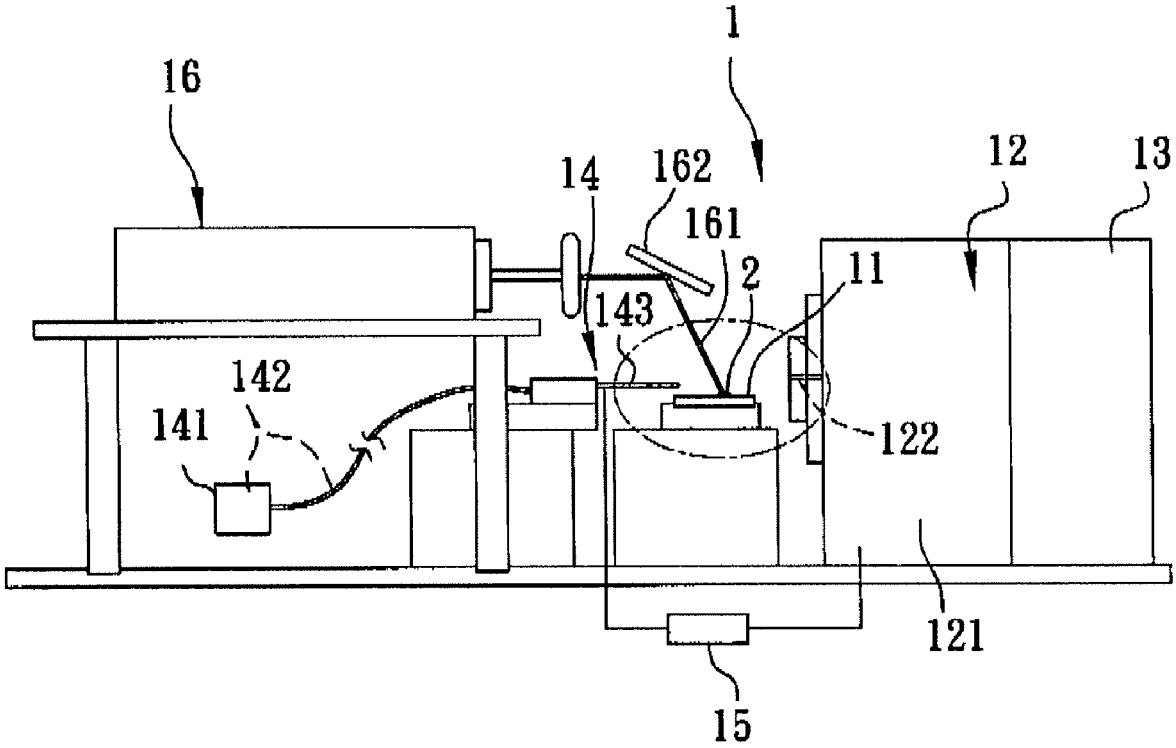
FIG. 1 is a schematic view of a mass spectrometer for implementing the preferred embodiment of a mass spectroscopic reaction-monitoring method according to the present invention.

FIG. 1 illustrates a mass spectrometer 1 for implementing the preferred embodiment of a mass spectroscopic reaction-monitoring method according to the present invention. The mass spectrometer 1 includes a sample stage 11, a receiving unit 12, a detector 13, an electrospray unit 14, a voltage supplying member 15, and a laser unit 16.

The sample stage 11 permits placement of a liquid sample thereon.

The receiving unit 12 is disposed to admit therein ionized analytes that are derived from the liquid sample, and includes a mass analyzer 121. The mass analyzer 121 is formed with a conduit 122 for receiving the ionized analytes to be analyzed by the mass analyzer 121.

The detector 13 is disposed to receive signals generated by the mass analyzer 121 as a result of analyzing the ionized analytes so as to generate a mass spectroscopic analysis result. In this embodiment, the mass spectroscopic analysis result includes at least one mass spectrum and/or a chromatograph.

The electrospray unit 14 includes a reservoir 141 for accommodating a liquid electrospray medium 142, and a nozzle 143 disposed downstream of the reservoir 141. The nozzle 141 is configured to sequentially form liquid drops of the electrospray medium 142 thereat, and is spaced apart from the conduit 122 of the mass analyzer 121 of the receiving unit 12 in a longitudinal direction so as to define a traveling path.

The voltage supplying member 15 is disposed to establish between the nozzle 143 of the electrospray unit 14 and the mass analyzer 121 of the receiving unit 12 a potential difference which is of an intensity such that the liquid drops are forced to leave the nozzle 143 as charge-laden ones for heading toward the conduit 122 of the mass analyzer 121 along the traveling path.

The laser unit 16 is capable of transmitting a laser beam 161, which is directed by an overhead laser beam directing member 162 to irradiate a region that is to be formed of a liquid sample surface such that, upon irradiation, at least one analyte present behind the liquid sample surface relative to the overhead laser beam directing member 162 is desorbed to fly along at least one flying path. Preferably, the liquid sample is a liquid drop 2 (as that illustrated in FIG. 1), and the liquid sample surface is the surface-tensed area of the liquid drop. Alternatively, the liquid sample is contained in an open reaction cell (not shown) that is disposed on the sample stage 11, and the liquid sample surface is a level of the liquid sample in the open reaction cell.

The mass spectroscopic reaction-monitoring method will now be described with reference to the mass spectrometer 1 illustrated in FIG. 1.

First, sequentially generated charge-laden liquid drops are forced to move towards the receiving unit 12 of the mass spectrometer 1 along the traveling path. In this embodiment, the sequentially generated charge-laden liquid drops are formed by the electrospray unit 14 at the nozzle 143 thereof, and are forced to move towards the mass analyzer 121 of the receiving unit 12 by the electrospray unit 14 under the electric field generated by the voltage supplying member 5.

Second, the region that is to be formed of the liquid sample surface is exposed to the laser beam 161. In this embodiment, the laser beam 161 is emitted from the laser unit 16, and has an irradiation energy sufficient to cause the analytes present behind the liquid sample surface relative to the overhead laser beam directing member 162 to be desorbed to fly along the at least one flying path.

Third, a liquid sample 2 is introduced to the region so as to form the liquid sample surface at successive points of time that are respectively spaced a plurality of predetermined intervals apart. The liquid sample 2 contains at least one reactant that undergoes an ongoing chemical reaction as a first one of the analytes to form at least one product that co-exist therewith as a second one of the analytes.

Fourth, the liquid sample surface is positioned relative to the laser beam 161 at each of the successive points of time to render the at least one flying path to intersect the traveling path so as to enable at least one of the coexisting first and second analytes to be occluded in at least one of the charge-laden liquid drops to thereby form at least a corresponding one of first and second ionized analytes.

Subsequently, a plurality of mass spectra are obtained for the plurality of successive points of time. Each of the mass spectra is obtained through analyzing the at least a corresponding one of the first and second ionized analytes which correspond to the liquid sample introduced at a corresponding one of the successive points of time.

Next, first and second representative mass-to-charge ratio (m/z) signals which respectively characterize the first and second analytes are preferably selected from the plurality of mass spectra.

Finally, a reaction rate of the chemical reaction is determined based on changes of intensities respectively for the first and second representative mass-to-charge ratio signals with reference to corresponding elapses of the predetermined time intervals.

Preferably, a suitable matrix is added to the liquid sample for conducting the mass spectroscopic analysis.

The matrix is made from a material that is non-transmissible by laser. More preferably, the matrix is selected from the group consisting of gold, carbon, cobalt, iron, 2,5-dihydroxybenzoic acid (2,5-DHB), 3,5-dimethoxy-4-hydroxycinnamic acid (sinapinic acid, (SA)), α-cyano-4-hydroxycinnamic acid (α-CHC), and a combination thereof. Optionally, the matrix has a particle diameter ranging from 50 nm to 50 μm. In this embodiment of the present invention, carbon powders with particle diameter of less than 50 μm are added to the liquid sample to serve as the matrix.

Since the mass spectroscopic reaction-monitoring method is capable of monitoring various kinds of chemical reactions, such as organic reactions, biochemical reaction (e.g., enzyme digesting protein reactions), organic metal complexation reactions, etc., no limitation is imposed on the liquid sample used. The solution portion of the liquid sample may be an aqueous solution or an organic solution. The analytes contained in the liquid sample (i.e., those related to the reaction) may be a biochemical substance, such as protein, or an organic compound.

The electrospray unit 14 may operate in a "positive ion mode" (i.e., voltage level at the mass analyzer 121 is higher than that at the nozzle 143), or in a "negative ion mode" (i.e., voltage level at the mass analyzer 121 is lower than that at the nozzle 143).

The electrospray medium 142 preferably includes water, organic solvents, or a combination thereof. Further, in order to prevent interference due to the addition of cations such as $Na^+$ and $K^+$ in the electrospray medium 142, which results in a complicated mass spectrum, the electro spray medium 142 is more preferably a solution containing a volatile liquid. For example, the electrospray medium 142 may contain one of isoacetonitrile, acetone, alcohol, and a combination thereof. More preferably, the electrospray medium 142 is alcohol. Optionally, the electrospray medium 142 contains an acid to facilitate ionization of the analytes. The acid may be selected from the group consisting of formic acid, acetic acid, trifluoroacetic acid, and a combination thereof. In the embodiments of the present invention, the electrospray medium 142 is methanol.

Preferably, the laser unit 16 is selected from the group consisting of an infrared (IR) laser, an ultraviolet (UV) laser, a nitrogen laser, an argon ion laser, a helium-neon laser, a carbon dioxide ($CO_2$) laser, and a garnet (Nd:YAG) laser. In one embodiment of the present invention, the laser unit 16 is an ultraviolet laser for providing an ultraviolet laser beam.

No limitation is imposed upon the wavelength, energy, and frequency of the laser beam 161 transmitted by the laser unit 16, as long as the laser beam 161 is capable of desorbing at least one of the analytes from behind the liquid sample surface when the latter is irradiated thereby. For the ultraviolet laser, the pulse energy is preferably higher than 20 μJ, and more preferably between 100 μJ and 150 μJ. In this embodiment, the pulse energy of the laser beam 161 is 120 μJ, and the laser beam 161 forms a spot size of 0.5 $mm^2$ on the liquid sample surface.

U.S. patent application Ser. No. 11/561,131 may be referred to for other operational parameters related to the electrospray unit 14, the mass analyzer 121, and the detector 13.

It should be noted herein that since hydroxyl group, primary amino group, secondary amino group, etc. are highly absorbent to infrared (IR) light, when the liquid sample contains the above substances (e.g., water, amino, etc.), the substances may serve as the matrix. Therefore, it is particularly suitable to use an infrared laser as the laser unit 16 when the liquid sample contains water.

Moreover, the mass spectroscopic result obtained by carrying out the mass spectroscopic reaction-monitoring method of the present invention may be an average mass spectrum for a period of time, a single-scan mass spectrum for a particular point of time, or a chromatograph for a particular analyte (used to investigate the variation of the particular analyte over time). In addition, the plurality of time intervals between the successive points of time at which the liquid sample is introduced are chosen depending on the characteristic of the reaction under monitor, and may vary according to operational conditions.

It should be noted herein that the preferred embodiment disclosed herein is merely presented for the purpose of illustration, and should not be taken to limit the scope of the present invention.

Chemicals and Equipments Used

Exemplary methods 1~3 and comparative example 1 were conducted using the following chemicals:

1. laser unit: Ultraviolet (UV) Laser model no. VSL-337i, manufactured by Laser, Science Inc. of the United States. The laser beam transmitted by the ultraviolet laser has a wavelength of 337 nm, a frequency of 10 Hz, a pulse duration of 4 ns, and a pulse energy of 120 μJ.
2. Mass Analyzer (including the Detector): Quadrupole Time-of-Flight Mass Analyzer model no. BioTOF-Q, manufactured by Bruker Dalton company of Germany.
3. methanol (MeOH): a HPLC material manufactured by Merck of Germany (also known as German Merck)
4. ethanol (EtOH): model no. 459844 manufactured by Sigma-Aldrich company of the United States
5. Chalcone: molecular weight of 208, model no. 136123, manufactured by Aldrich company of the United States
6. acetic anhydride: molecular weight of 102.03, model no. 320102, manufactured by Sigma-Aldrich company of the United States
7. 4-aminophenol: molecular weight of 109.05, model no. 10968, manufactured by Fluka company
8. NaOH: model no. SK371842 manufactured by Nihon Shiyaku Industries Ltd.
9. $H_2O_2$: concentration of 30%, model no. 31692 manufactured by Riedel-de Haën company
10. Carbon powders: model no. 4206A manufactured by Merck company of Germany; particle diameter of below 50 μm.

In conducting the exemplary methods 1 to 3 presented hereinbelow, after choosing a particular reaction to monitor, a group of ionized analytes that correspond to the reactants, intermediate products and final products was predicted to be detected by the mass spectroscopic reaction-monitoring method of the present invention. The prediction was made in consideration of possible combinations of the reactants, intermediate products and final products to solvents, protons ($H^+$), $Na^+$, and/or other substances present in the environment (e.g., air).

For each of the exemplary methods, the following steps were conducted for obtaining the results thereof:

(i) It was first observed whether signals corresponding to the predicted ionized analytes were obtained to thereby verify the presence of the reactants, intermediate products and final products for the reaction in the liquid sample at the corresponding points of time. In addition, when signals corresponding to unpredicted ionized analytes were observed, the formation of these signals was to be investigated.

(ii) A chromatograph is constructed for each of particular ionized analytes in interest, i.e., particular ones of the reactants, intermediate products and final products chosen by selecting representative mass-to-charge ratio (m/z) signals to respectively characterize the particular ionized analytes, so as to facilitate the investigation of signal intensities of the corresponding ionized analyte over time.

If not specified otherwise, the exemplary methods were conducted under room temperature and atmospheric pressure. The electrospray unit operated under the "positive ion mode", and methanol was used as the electrospray medium. During the course of each of experimentation for each of exemplary methods, all components of the mass spectrometer other than the laser unit were turned on the whole time. Moreover, the "points of time" were calculated with respect to the beginning of the experiment. In addition, in each of the exemplary methods, representative m/z signals were chosen from the average of the mass spectra obtained at the different points of time, and the chromatography were constructed only for the chosen representative m/z signals.

<Exemplary Method 1> Monitoring the Tryptic Digestion of Cytochrome C

Prediction

Since trypsin is capable of cleaving the bond between arginin and lysine in proteins, it was predicted that the amount of peptide from cytochrome c would increase over time. Therefore, it can be assumed that the signals corresponding to peptide in the mass spectra obtained at the successive points of time would reveal an increase in relative intensity. In other words, it can be anticipated that the intensity of the peptide signal would approach, or even surpass, that of cytochrome c over time.

Procedure

In exemplary method 1, an aqueous solution containing a cytochrome c standard ($10^{-4}$M) was mixed with carbon powders (8 mg/ml). Subsequently, magnetic nano-particles (provided privately) coated with trypsin (2.5 μg/μL) were added into the aqueous solution to form the liquid sample. A drop of the liquid sample was withdrawn and deposited on the sample stage 11 (shown in FIG. 1) every minute starting at minute 0 for analysis conducted using the mass spectroscopic reaction-monitoring method of the present invention.

Three representative mass spectra obtained from the droplets respectively collected at minutes 0, 15 and 30 are illustrated in FIG. 2(*a*) to FIG. 2(*c*), respectively. The composition of the liquid sample used and the information related to the results obtained for exemplary method 1 are tabulated in Table 1 below.

TABLE 1

Figure 2A:
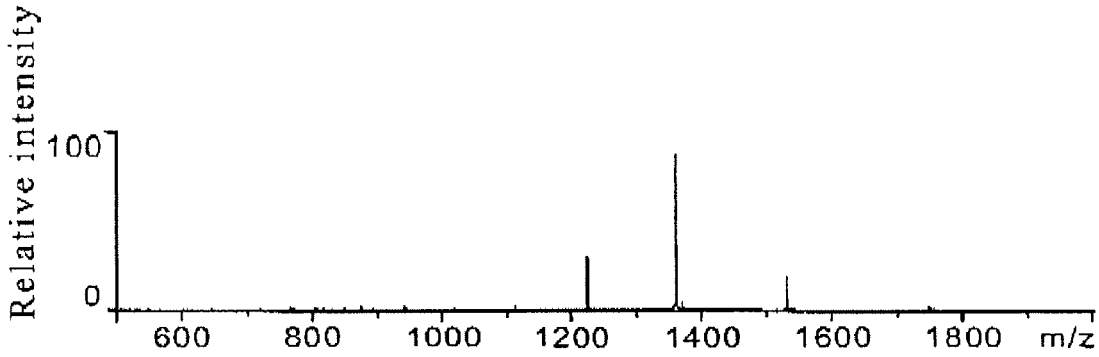
FIGS. 2(*a*) to 2(*c*) are single-scan mass spectra obtained for exemplary method 1.
Figure 2B:
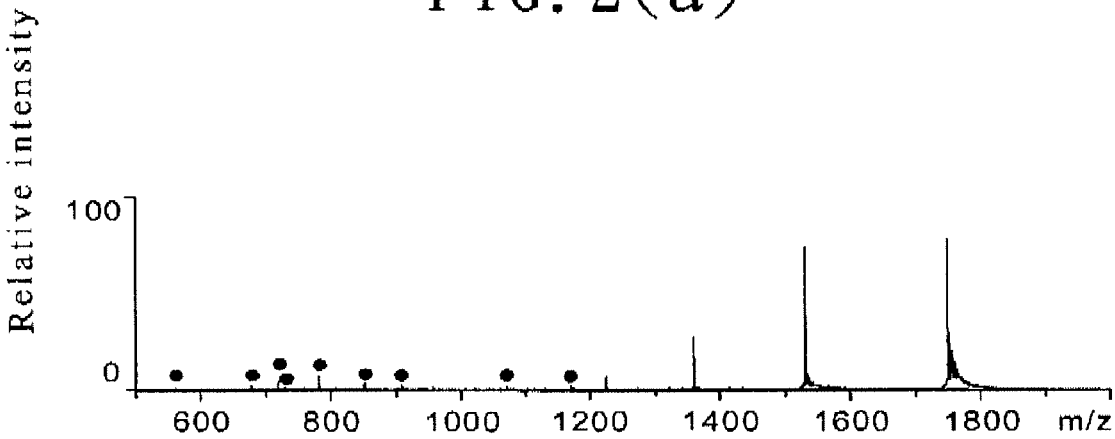
Figure 2C:
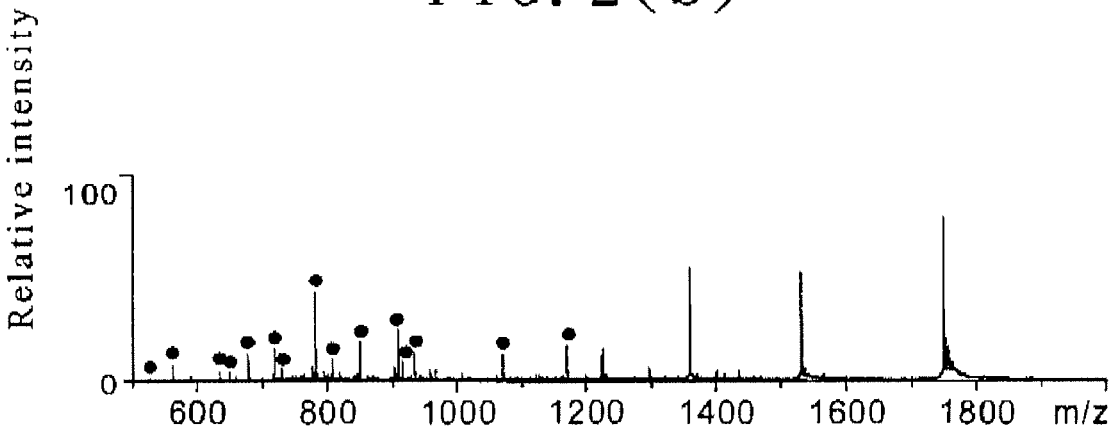

| | | | | |
|---|---|---|---|---|
| Liquid Sample | Matrix Reactants | Carbon Powder (0.8 mg/μL) Cytochrome c ($10^{-4}$M) Magnetic Nano-Particles (concentration 2.5 μg/mL) | | |
| Reaction Time | | Minute 0 | Minute 15 | Minute 30 |
| Single-scan Mass Spectrum | | FIG. 2(a) | FIG. 2(b) | FIG. 2(c) |

Results

As shown in FIG. 2(*a*), all three of the apparent signals observed originate from cytochrome c, and no signal corresponding to peptide is observed. As shown in FIG. 2(*b*) and FIG. 2(*c*), signals corresponding to peptide are observed, and are denoted by "●". In addition, the relative intensities of the peptide signals in FIG. 2(*c*) are higher than those in FIG. 2(*b*), and are closer to the relative intensities of the signals corresponding to cytochrome c.

It is verified by the results that the mass spectroscopic reaction-monitoring method of the present invention is capable of monitoring the progress of a biochemical reaction.

<Exemplary Method 2> Monitoring Epoxidation Reaction of Chalcone

Prediction

The chemical reaction in interest is illustrated in the figure below:

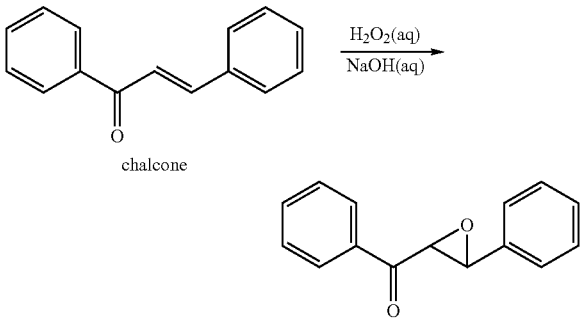

where the molecular weight of chalcone, serving as the reactant, is 208, and the molecular weight of the product is 224. In addition, since the liquid sample contains $Na^+$ ions, it was predicted that the signals (represented by corresponding m/z values) corresponding to the ionized analytes tabulated in Table 2 would be detected.

TABLE 2

| m/z value | Ionized Analyte |
|---|---|
| 209 | Chalcone + $H^+$ |
| 231 | Chalcone + $Na^+$ |
| 247 | Product + $Na^+$ |

Procedure

In exemplary method 2, a liquid sample containing 3 ml of EtOH, 24 mg of carbon powders and 75 mg of chalcone (i.e., the reactant in exemplary method 2) was disposed in an open reaction cell. Starting from minute 0.4, the liquid sample surface (i.e., level of the liquid sample in the open reaction cell) was irradiated by a laser beam. At minute 1.8, 0.5 ml of $H_2O_2$ aqueous solution was added into the liquid sample. At minute 2.26, 0.5 ml of 5% NaOH aqueous solution was added into the liquid sample, and a large amount of bubbles were observed. The mass spectroscopic analysis was conducted for a total of 5.5 minutes.

Results

Figure 3A:
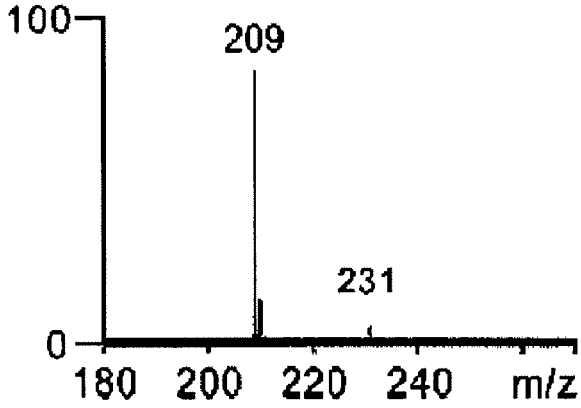
FIGS. 3(*a*) to 3(*c*) are single-scan mass spectra obtained for exemplary method 2.
Figure 3B:
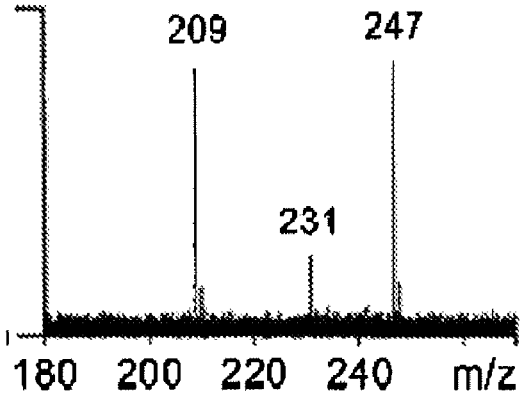
Figure 3C:
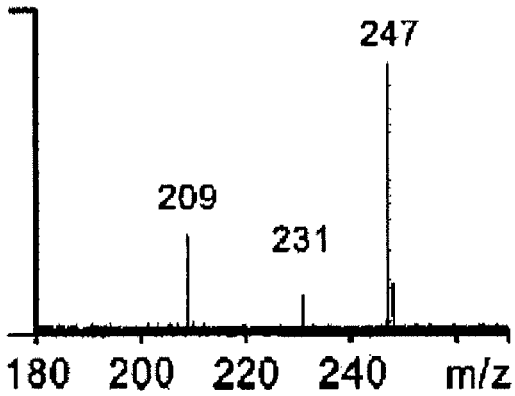
Figure 4:
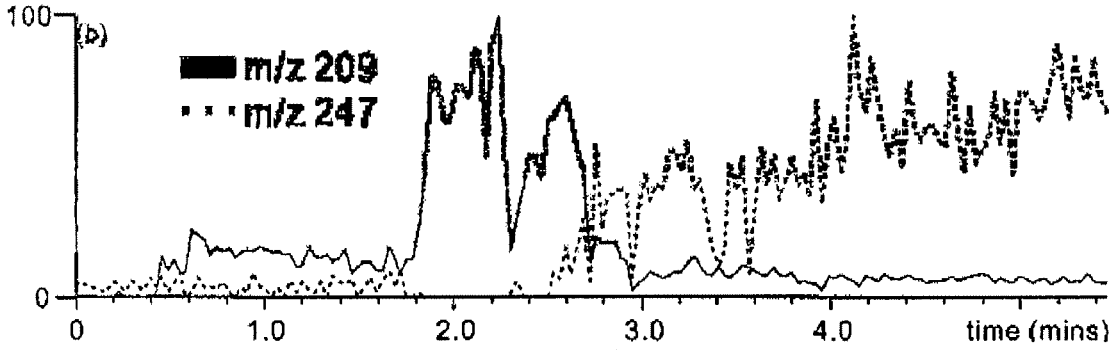
FIG. 4 is a chromatograph constructed for two representative m/z signals in exemplary method 2, FIGS. 5(*a*) to 5(*c*) are average mass spectra obtained for exemplary method 3.

Three single-scan mass spectra were chosen for illustration purposes and are shown in FIGS. 3(*a*)~3(*c*), and a chromatograph illustrated in FIG. 4 was constructed for two representative m/z signals selected. Information related to the results of exemplary method 2 is tabulated in Table 3 below.

TABLE 3

| Result Type | Figure No. | Time | m/z signal |
|---|---|---|---|
| Mass Spectra | FIG. 3(a) | Minute 2 | 209, 231 |
| | FIG. 3(b) | Minute 2.75 | 209, 231, 247 |
| | FIG. 3(c) | Minute 4.0 | 209, 231, 247 |
| Chromatograph | FIG. 4 | Minutes 0~5.5 | 209 (reactant-related), 247 (product-related) |

As shown in FIGS. 3(*a*)~3(*c*), the signal with m/z=209 that corresponds to "chalcone+$H^+$" comes out as the strongest in intensity, and as the reaction progresses over time, the intensity of the signal with m/z=247 that corresponds to "product+$Na^+$" surpasses that of "chalcone+$H^+$". This verifies the decline of the reactant, i.e., chalcone, and the growth of the product as the reaction progresses over time.

As shown in FIG. 4, it is obvious that at minute 1.8, the reactant signal with m/z=209 abruptly increases in intensity. It is assumed that this is due to a higher level of the liquid sample surface relative to the electrospray unit 14 (i.e., closer to the charge-laden liquid drops) attained by the addition of the $H_2O_2$ aqueous solution thereto, resulting in the increased ionizing efficiency of the analytes desorbed from behind the liquid sample surface.

<Exemplary Method 3> Monitoring Reaction between 4-aminophenol and acetic anhydride Prediction The mechanisms of the reaction between 4-aminophenol and acetic anhydride are illustrated in the following figures:

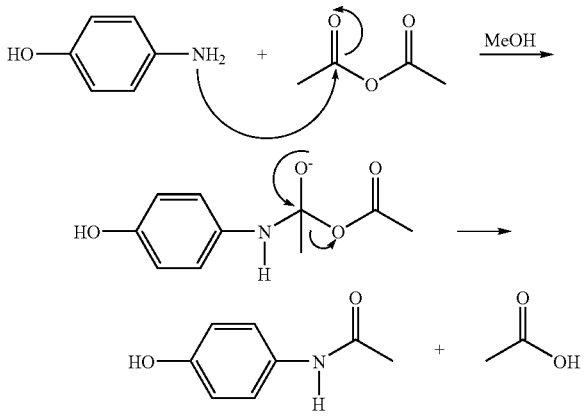

-continued

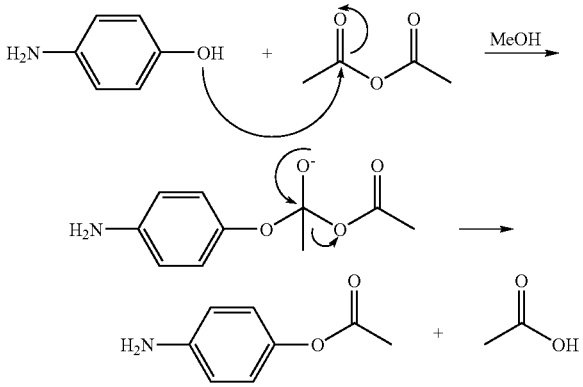

where the molecular weight of 4-aminophenol (hereinbelow referred to as reactant 1) is 109.05, the molecular weight of acetic anhydride (hereinbelow referred to as reactant 2) is 102.03, the molecular weight of the intermediate product is 211.08, and the molecular weight of the final product is 151.06. In addition, it was predicted that the signals (represented by corresponding m/z values) corresponding to the ionized analytes tabulated in Table 4 would be detected, where the predicted m/z values are in whole numbers.

TABLE 4

| m/z value | Ionized Analyte | m/z value | Ionized Analyte |
|---|---|---|---|
| 110 | reactant 1 + $H^+$ | 125 | reactant 2 + $Na^+$ |
| 120 | reactant 2 + $H_2O$ | 152 | final product + $H^+$ |
| 222 | dimer of reactant 2 + $H_2O$ | 212 | intermediate product + $H^+$ |
| 227 | dimer of reactant 2 + $Na^+$ | | |

Procedure

In exemplary method 3, 30 μl of ethanol solution containing 4-aminophenol with $1.0*10^{-2}$M concentration and carbon powders with 8 mg/ml concentration was used as the liquid sample, and was disposed in an open reaction cell. Starting from minute 0.2, the liquid sample surface (i.e., level of the liquid sample in the open reaction cell) was irradiated by a laser beam. At minute 0.5, 30 μl of acetic anhydride was added into the liquid sample. The mass spectroscopic analysis was conducted for a total of 2.3 minutes.

Results

Three average mass spectra were chosen for illustration purposes and are illustrated in FIGS. 5(*a*)~5(*c*), and seven chromatograph shown in FIGS. 6(*a*)~6(*g*) were constructed for seven representative m/z signals selected. Information related to the results of exemplary method 3 is tabulated in Table 5 below.

TABLE 5

Figure 5A:
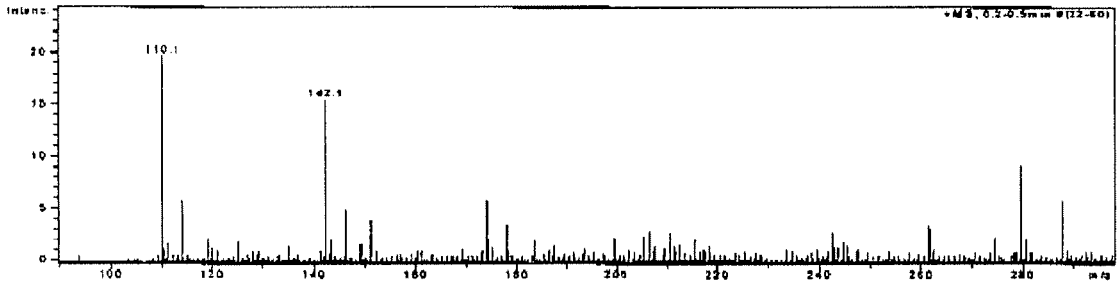
Figure 5B:
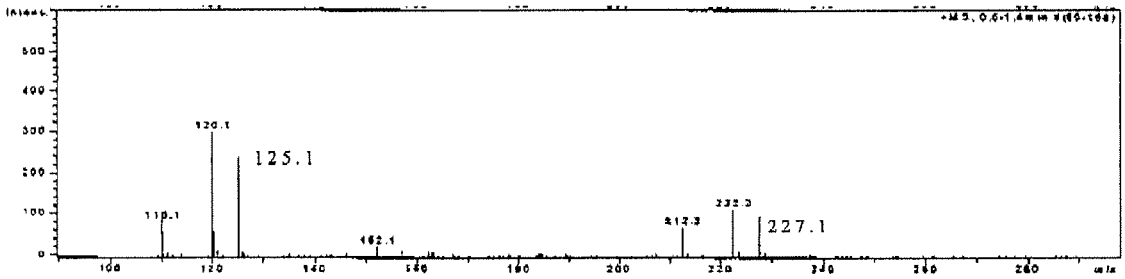

| Result Type | Figure No. | Time | m/z signal |
|---|---|---|---|
| Mass Spectra | FIG. 5(a) | Minute 0.2~0.5 | 110.1, 142.1 (reactant 1-related) |
| | FIG. 5(b) | Minute 0.5~1.4 | 110.1 (reactant 1-related), 120.1, |

TABLE 5-continued

Figure 5C:
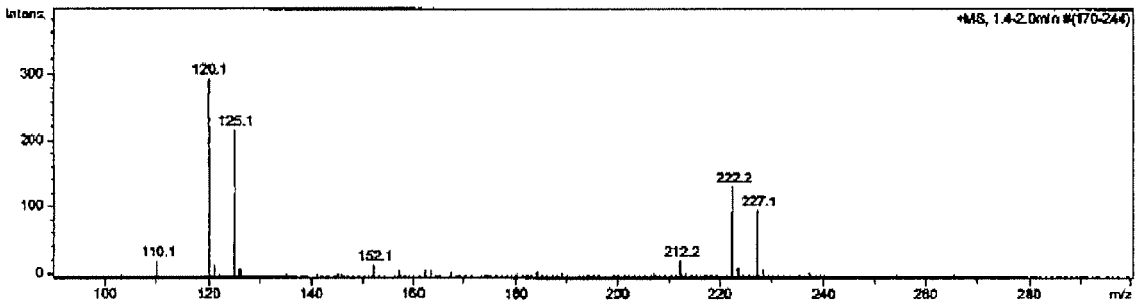
Figure 6A:
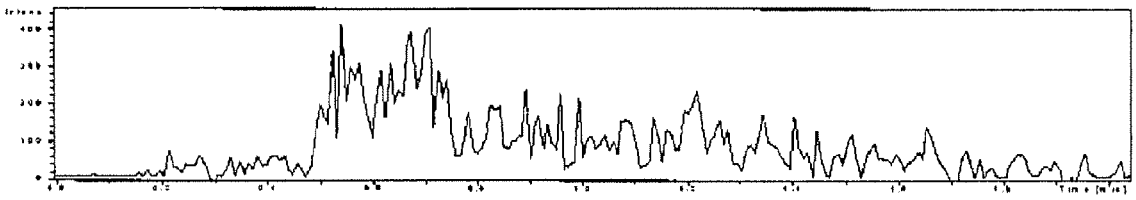
FIGS. 6(*a*) to 6(*g*) are chromatographs respectively constructed for seven representative m/z signals in exemplary method 3.
Figure 6B:
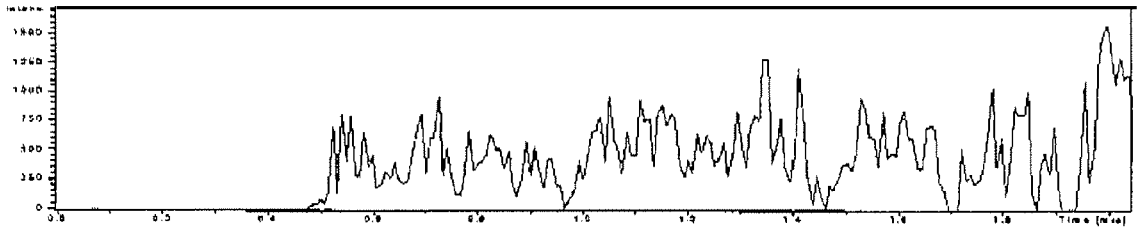
Figure 6C:
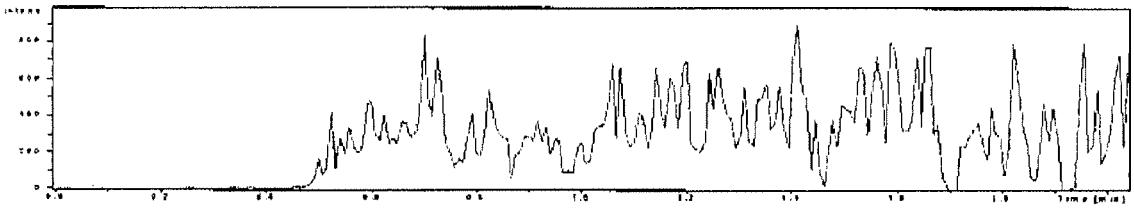
Figure 6D:
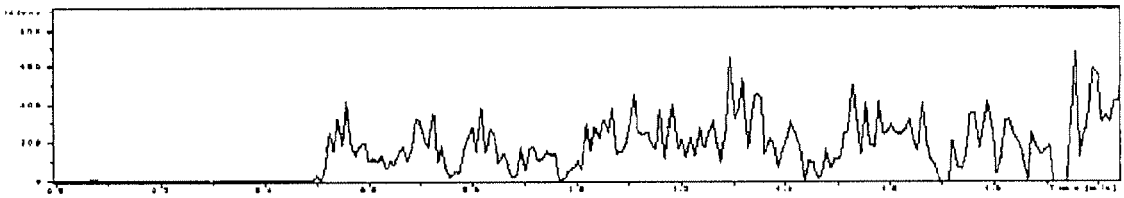
Figure 6E:
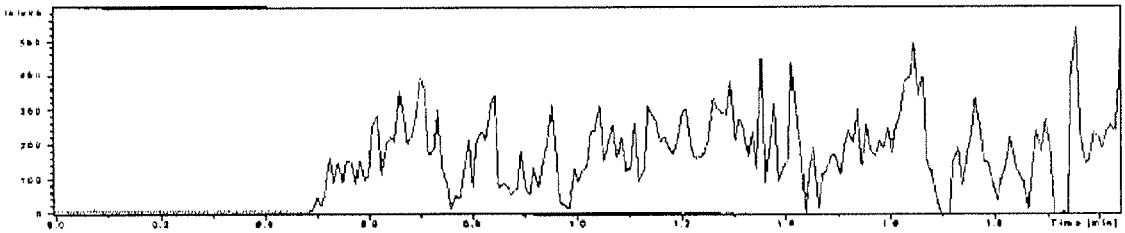
Figure 6F:
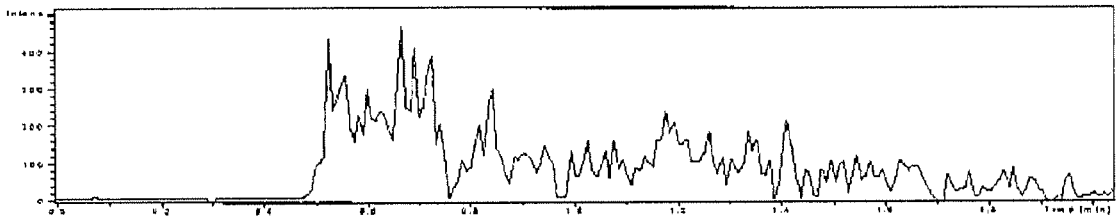
Figure 6G:
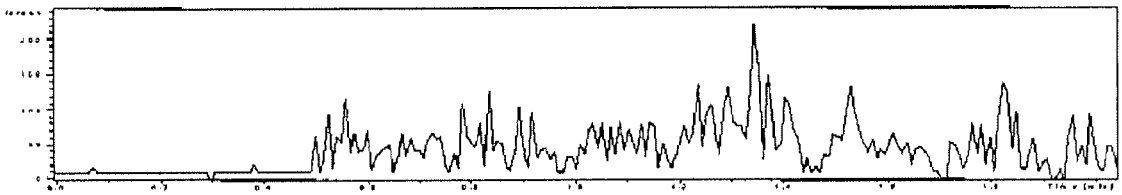

| Result Type | Figure No. | Time | m/z signal |
|---|---|---|---|
| | FIG. 5(c) | (reactant 2 added) Minute 1.4~2.0 | 125.1, 222.2, 227.1 (all reactant 2-related), 212.2 (intermediate product-related), 152.1 (final product-related) |
| Chromatograph | FIG. 6(a) | Minute 0~2.2 | 110.1 (reactant 1-related) |
| | FIG. 6(b) | | 120.1 (reactant 2-related) |
| | FIG. 6(c) | | 125.1 (reactant 2-related) |
| | FIG. 6(d) | | 222.2 (reactant 2-related) |
| | FIG. 6(e) | | 227.1 (reactant 2-related) |
| | FIG. 6(f) | | 212.2 (intermediate product-related) |
| | FIG. 6(g) | | 152.1 (final product-related) |

As shown in FIGS. 5(*a*)~5(*c*), the signal with m/z=110.1 that corresponds to "reactant 1+$H^+$" comes out as the strongest in intensity, and as the reaction progresses over time, the intensities of the signals originated from reactant 2 or various products surpass that of "reactant 1+$H^+$". This verifies the decline of reactant 1 and the growth of the products. In FIG. 5(*c*), i.e., during minute 1.4~2.0, the intensities of the reactant 2-related signals with m/z values of 120.1, 125.1, 222.2, 227.1 are obviously higher than those of the reactant 1-related signals and the product-related signals. It is assumed that this is due to the acidic nature of reactant 2 and the fact that the exemplary method 3 was conducted under the "positive ion mode", resulting in a higher ionization rate of reactant 2. As shown in FIG. 6(*f*) and FIG. 6(*g*), the intermediate product and the final product were produced starting at minute 0.5 upon the addition of reactant 2. It is apparent from FIG. 6(*f*) that the intensity of the intermediate product-related signal abruptly increases at minute 0.5, and gradually decreases over time, thereby verifying the growth and decline of an intermediate product in a chemical reaction.

Figure 7:
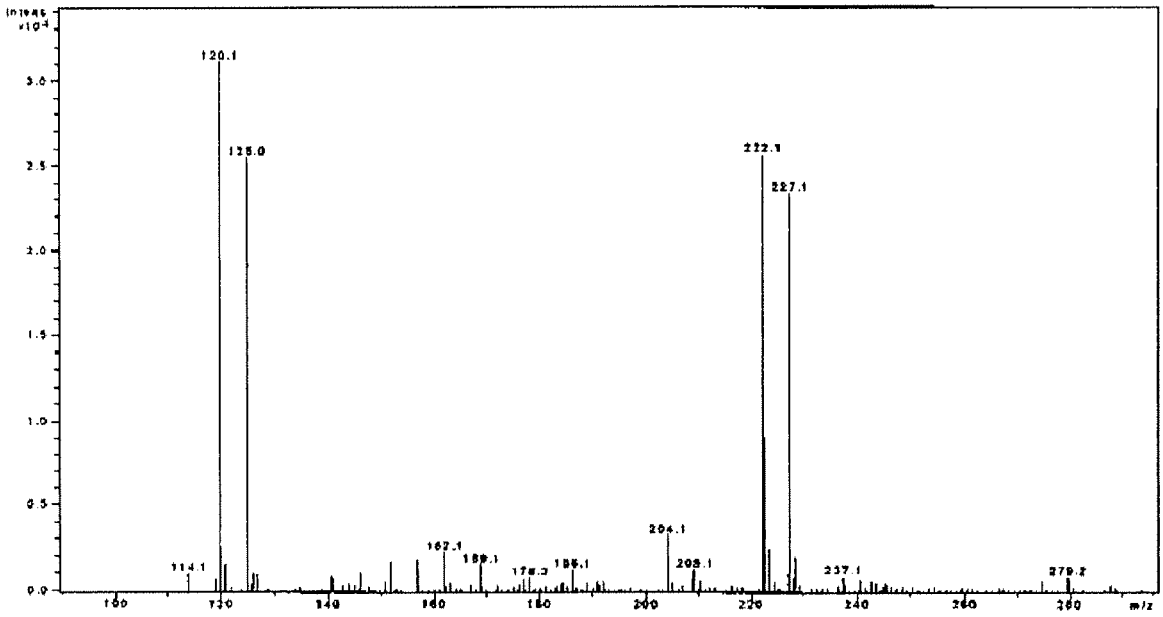
FIG. 7 is an average mass spectrum obtained for comparative example 1.

<Comparative Case 1> Conducting Mass Spectroscopic Analysis on acetic anhydride Using Electrospray Ionization (ESI) Methods ESI Analysis was conducted on acetic anhydride (i.e., reactant 2 in exemplary method 3), and the obtained mass spectrum is illustrated in FIG. 7. The main ion peaks observed in FIG. 7 respectively have m/z values of 120.1, 125.0, 222.1 and 227.1, which are also observed in FIGS. 5(*b*)~5(*c*). This verifies the credibility of the reactant 2-related signals detected in exemplary method 3.

With reference to the results described hereinabove with respect to the exemplary methods, it is evident that the mass spectroscopic reaction-monitoring method according to the present invention has the ability to conduct instantaneous analysis on a liquid sample, and to monitor an ongoing reaction in the liquid sample by observing the differences among the results obtained at successive points of time. In addition, the present invention is applicable to various kinds of liquid samples, including aqueous, organic, biochemical solutions, etc. Moreover, the mass spectroscopic reaction-monitoring method is capable of eliminating the shortcomings presented in the prior art by using EST mass spectrometry.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

This invention claimed is:

1. A mass spectroscopic reaction-monitoring method comprising the steps of:

forcing sequentially generated charge-laden liquid drops to move from a nozzle towards a receiving unit of a mass spectrometer along a traveling path defined in a longitudinal direction between the nozzle and the receiving unit;

exposing to a laser beam a region that is to be formed of a liquid sample surface, the laser beam being transmitted from an overhead laser directing member and having an irradiation energy sufficient to cause analytes present behind said liquid sample surface relative to said laser unit to be desorbed to fly along at least one flying path;

introducing a liquid sample to said region so as to form the liquid sample surface at successive points of time that are spaced a plurality of predetermined intervals apart, the liquid sample containing at least one reactant that undergoes an ongoing chemical reaction as a first one of the analytes to form at least one product that co-exist therewith as a second one of the analytes; and positioning said liquid sample surface relative to said laser beam at each of said successive points of time such that said at least one flying path intersects said traveling path to enable at least one of said coexisting first and second analytes to be occluded in at least one of said charge-laden liquid drops to thereby form at least a corresponding one of first and second ionized analytes.

2. A mass spectroscopic reaction-monitoring method according to claim 1, wherein said liquid sample surface is a level of the introduced liquid sample contained in an open reaction cell.

3. A mass spectroscopic reaction-monitoring method according to claim 2, wherein the liquid sample is a liquid drop, and said liquid sample surface is a surface-tensed area of the liquid drop.

4. A mass spectroscopic reaction-monitoring method according to claim 1, further comprising the step of obtaining a plurality of mass spectra for the plurality of successive points of time, each of said mass spectra being obtained through analyzing said at least a corresponding one of the first and second ionized analytes which correspond to the liquid sample introduced at a corresponding one of the successive points of time.

5. A mass spectroscopic imaging method according to claim 4, further comprising the step of selecting first and second representative mass-to-charge ratio (m/z) signals which respectively characterize said first and second analytes from said plurality of mass spectra.

6. A mass spectroscopic imaging method according to claim 5, further comprising the step of determining a reaction rate of the chemical reaction based on changes of intensities respectively for said first and second representative mass-to-charge ratio signals with reference to corresponding elapses of the predetermined time intervals.

* * * * *